US005203354A

United States Patent [19]

Hickle

[11] Patent Number: 5,203,354

[45] Date of Patent: Apr. 20, 1993

[54] RESTRUCTURED TOBACCO DRYER

[75] Inventor: John N. Hickle, Richmond, Va.

[73] Assignee: Philip Morris Incorporated, New York, N.Y.

[21] Appl. No.: 723,164

[22] Filed: Jun. 28, 1991

[51] Int. Cl.[5] ..... A24B 3/14

[52] U.S. Cl. ..... 131/296; 131/305; 131/306; 131/357; 131/370; 34/112

[58] Field of Search ..... 131/56, 57, 290, 296, 131/305, 306, 355-358, 370-374; 34/110, 112, 164, 68, 18

[56] References Cited

U.S. PATENT DOCUMENTS

| | | | |
|---|---|---|---|
| 1,597,183 | 8/1926 | Devine | 34/112 |
| 2,656,841 | 10/1953 | Gurley | 34/68 X |
| 3,040,442 | 6/1962 | Overton | 34/110 |
| 3,081,779 | 3/1963 | Perrin | 34/112 X |
| 3,386,450 | 6/1968 | Seligman . | |
| 3,430,634 | 3/1969 | Schweitzer et al. . | |
| 3,785,425 | 1/1974 | Hyldon | 34/110 X |
| 4,045,638 | 8/1977 | Chiang et al. | 34/164 X |
| 4,251,927 | 2/1981 | Luthi | 34/110 |
| 4,497,331 | 11/1982 | Neller | 131/353 |
| 4,625,736 | 12/1986 | Rothchild | 131/296 |
| 4,674,519 | 6/1987 | Keritses et al. | 131/355 |

FOREIGN PATENT DOCUMENTS 1171878 11/1969 United Kingdom .

*Primary Examiner*—William H. Grieb
*Assistant Examiner*—J. Doyle
*Attorney, Agent, or Firm*—Mitchell P. Brook

[57] ABSTRACT

An apparatus and method for manufacturing reconstituted tobacco sheet in which a tobacco containing slurry is metered on to the outer surface of a rotating heated cylindrical dryer and then, after sufficient drying, is removed from the cylindrical dryer.

11 Claims, 1 Drawing Sheet

RESTRUCTURED TOBACCO DRYER

BACKGROUND OF THE INVENTION

The present invention relates generally to an apparatus and method for manufacturing reconstituted tobacco sheet and more particularly to an apparatus and method in which reconstituted tobacco sheet is produced by applying a tobacco containing slurry to a heated cylindrical dryer.

During the production and processing of tobacco products, including aging, blending, sheet forming, cutting, drying, cooling, screening, shaping and packaging, considerable amounts of tobacco fines, dust, stems and other small tobacco plant parts are generated. It is known that such small tobacco plant parts can be combined with a binder material to form a coherent sheet, which resembles leaf tobacco and which is commonly referred to as reconstituted tobacco.

It is also known to produce such reconstituted tobacco sheet by a variety of processes. A commonly used process is known as a band process, which is described in U.S. Pat. No. 4,497,331. Such a process typically involves applying a slurry of tobacco particles plus other additives and adhesives by some means, such as a reverse roll coater, to a continuous carrier belt where the slurry is partially dried (typically to a moisture content of about 40%). Then, after the sheet is removed from the belt it is dried further to an acceptable moisture level, typically about 16%.

Another known process uses a paper making machine in which water is drained from a fibrous slurry of tobacco particles, and sheet that is formed is subsequently treated and dried. Such paper making machines are described in U.S. Pat. No. 4,497,331 and in United Kingdom patent No. 1,171,878.

The band process and apparatus possesses a number of known disadvantages. One such disadvantage is that the carrier belt typically is over 100 feet in length, and may be as long as 400 feet. Accordingly, there is need in the art for an apparatus and method for making a reconstituted tobacco sheet that uses a smaller and more economical apparatus.

Another disadvantage is that ammonia typically is added to the tobacco containing slurry in order to break down pectin in order to speed the formation of a coherent sheet. As a consequence, tobacco shreds cut from such ammonia containing sheet generally are not used in menthol cigarettes because ammonia reacts with menthol to cause an undesirable taste. Accordingly, there is a need in the art for an apparatus and method for making reconstituted tobacco sheet that does not require the use of ammonia.

A further disadvantage is low tensile strength of the reconstituted tobacco sheet, which causes increased generation of tobacco fines from cutting operations. In known processes, tensile strength is reduced because high temperatures are required to produce adequate drying during high speed operation.

SUMMARY OF THE INVENTION

The present invention alleviates to a great extent the disadvantages of the prior art by providing an apparatus and method for making reconstituted tobacco sheet that employs a heated cylindrical dryer to dry the tobacco slurry and form a sheet. Employing the present invention, the required drying time is reduced and the space required to house the apparatus is significantly reduced.

In the present invention, a slurry containing tobacco particles, and optionally containing additives and adhesives, is metered onto the heated cylindrical dryer. Any metering apparatus may be used, such as application rolls or casting boxes. As the heated cylindrical dryer rotates, the slurry dries to form a sheet. At a point at which the moisture level has sufficiently been reduced, the sheet is removed from the drum and transferred for further processing into desired tobacco products or to be stored.

In an embodiment of the present invention, the reconstituted tobacco sheet is transferred to a cutter, after being removed from the heated cylindrical drum dryer, and the cut sheets are transferred to a second dryer for additional drying.

It is an object of the present invention to reduce the drying time heretofore involved in manufacturing reconstituted tobacco sheet.

It is another object of the invention to reduce the amount of space required to house the apparatus used in manufacturing reconstituted tobacco sheet.

It is yet another object of the invention to provide an apparatus and method for manufacturing a high quality reconstituted tobacco sheet with higher tensile strength than is produced in current processes.

It is a further object of the invention to provide an apparatus and method for manufacturing reconstituted tobacco sheet without breaking down the pectins in the tobacco and without including ammonia as an additive to the tobacco containing slurry by providing adequate drying without the use of ammonia.

It is another object of the invention to provide an apparatus and method for manufacturing reconstituted tobacco sheet that can be used, after further processing, as a component of menthol cigarettes.

It is yet another object of the invention to provide an economical apparatus and method for manufacturing reconstituted tobacco sheet.

BRIEF DESCRIPTION OF THE DRAWING

The above and other objects and advantages of the invention will be apparent upon consideration of the following detailed description, taken in conjunction with the accompanying drawing, FIG. i, which is an elevation showing the apparatus of the present invention.

DETAILED DESCRIPTION OF THE INVENTION

Figure 1:
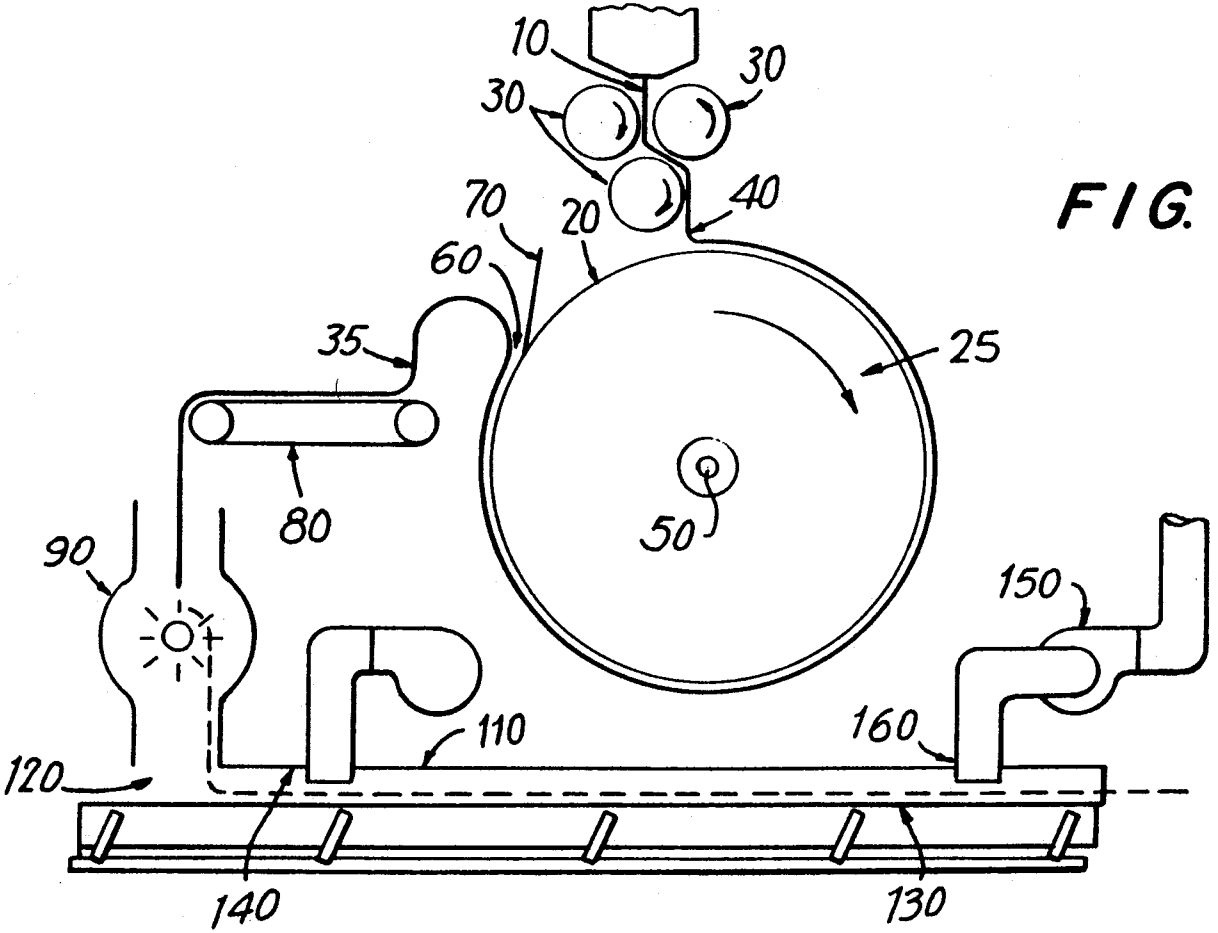

A tobacco containing slurry is formed into a reconstituted tobacco sheet by metering the slurry onto the outer surface of a rotating heated cylindrical dryer and then, after sufficient drying on the heated cylindrical dryer, transferring the sheet for further processing.

The tobacco containing slurry preferably comprises 80% moisture and 20% solids. The solids generally comprise tobacco particles and other additives or adhesives. The tobacco particles may be fines, dust, laminate, stems or other tobacco materials or mixtures. Tobacco is defined to include any fibrous or cellulose material, including by way of example expanded tobacco or other materials such as tobacco substitutes, stems or reconstituted tobacco.

The tobacco slurry 10 preferably is metered on to the outer surface 20 of the rotating cylindrical dryer 25, which preferably is a drum dryer 25. Application rolls 30, or other metering apparatus may be used to meter the tobacco slurry 10. In an embodiment using application rolls 30, the thickness of the tobacco sheet 35 is determined by the distance between the application rolls 30.

Various sizes and arrangements of application rolls 30 may be used. Preferably, each of the application rolls 30 is cylindrical, has a diameter that is less than that of the heated cylindrical dryer 25 and has a width that is substantially the same as that of the heated cylindrical dryer 25. If the application rolls 30 do not possess substantially the same width as the heated cylindrical dryer 25, then there will be wasted space because the width of the metered tobacco slurry 40 can be no greater than the width of the smaller of the application rolls 30 or the heated cylindrical dryer 25.

Other apparatus for metering the tobacco slurry onto the dryer 25 may be used. For example, casting boxes are equally effective and have been used for many years in industry.

The heated cylindrical dryer 25 is heated by any heat source, such as electricity, steam or gas. Preferably, steam is used because steam typically is generated as a byproduct of other manufacturing processes. Steam can be applied to the cylindrical dryer by directing a steam carrying pipe 50 into the inside of the cylindrical dryer at or near the axis of rotation. The outer surface 20 of the cylindrical dryer 25 preferably is made of steel or aluminum, but may be made of any material that can tolerate temperatures of 200° F. or higher and that does not deform significantly due to exposure to moisture. Stainless steel is preferred.

As the slurry 10 is metered on to the heated cylindrical dryer 25, it adheres to the outer surface 20 until it is removed at the doctoring point 60. As the heated cylindrical dryer 25 rotates, the slurry dries due to the heat applied to the surface by steam from pipe 50. Preferably, the slurry dries sufficiently to form a coherent reconstituted sheet by the time it is removed from the outer surface of the heated cylindrical dryer 20 when it reaches the doctoring point 60. Typically, a sharp blade 70 is used to cause the sheet to detach from the outer surface of the heated cylindrical dryer.

Preferably, the reconstituted sheet is dried to a 12–40% moisture content before it is removed from the cylindrical dryer 20 at the doctoring point 60. As the heated cylindrical dryer 20 rotates, the slurry progressively dries. The amount of drying is proportional to the total heat applied to the tobacco-containing slurry 40 while it is adhered to the outer surface 20 of the cylindrical dryer 25. The amount of heat is proportional to the amount of time that the slurry 40 is adhered to the outer surface 20 and to the temperature of the outer surface 20.

At higher the temperatures, there is more drying. However, if the temperature is too high, the flavor or other properties of the tobacco in the slurry may deteriorate. A preferable surface temperature, which will promote rapid drying without harming the tobacco, is between, and including, 180° F. and 200° F. However, lower or higher temperatures may also provide adequate drying.

The amount of drying also increases as the amount of time the slurry is adhered to the outer surface 20 of the cylindrical dryer increases. Various factors influence the amount of time, including the rate of rotation of the cylindrical dryer and the location of the doctoring point 60. As the rate of rotation increases, the amount of time the slurry is adhered to the outer surface 20 decreases. Likewise, as the doctoring point 60 is moved farther from the point at which the slurry is first applied to the cylindrical dryer, the amount of time increases.

Various sizes of dryers may be used. In the preferred embodiment, a cylindrical dryer (having a twelve foot diameter) is rotated at five rotations per minute and, as shown in FIG. 1, the doctoring point 60 is 300° around the drum from the point at which the slurry is first applied to the cylindrical dryer.

Reconstituted tobacco sheet of various moisture levels may be used in the manufacture of tobacco products. Generally, the reconstituted tobacco sheet used in manufacturing is dried to a moisture level between 10% and 20% and preferably the moisture level is about 16%. The heated cylindrical dryer is capable of drying the reconstituted sheet to this desired moisture level at, for example a 200° F. and one rotation per minute. In a second preferred embodiment of the invention, the heated cylindrical dryer may be used as the first step in a two-step drying operation as shown in FIG. 1, in which the reconstituted sheet has a moisture level exceeding the desired level when it is removed at the doctoring point 60, but is subsequently dried to the desired level.

In such a two-step drying operation, the sheet can be transferred, for example using a belt conveyor 80, to a cutting apparatus 90. After the sheet is cut in the cutter 90, the cut pieces are transferred to a second drying apparatus 100 where the sheet is dried to the desired moisture level. Alternatively, the reconstituted sheet may be transferred directly from the cylindrical dryer 25 to a second drying apparatus.

An advantage of using a belt conveyor 80 is that if a sufficiently long conveyor (typically between three and ten feet long) is selected, the reconstituted sheet will be stable and flat when it drops into the cutter 90. If the reconstituted sheet is stable and flat when it drops into the cutter 90, it is more likely that the sheet will be cut evenly. The belt conveyor 80 should be operated at a speed such that it does not cause the reconstituted sheet to tear or buckle. Typically it should be operated at a slightly lower speed than the cylindrical dryer 25 because normally the reconstituted sheet will shrink after it is removed form the outer surface 20 of the cylindrical dryer 25.

Typical cutters will slice the reconstituted sheet into squares or diamonds having four inch long edges. Alternative tools for cutting the sheet can be used, such as knives, scissors or roll dies.

After the reconstituted sheet in this preferred embodiment is cut, it is transferred to the second drying apparatus for further drying to the desired moisture level. Then it is transferred to a storage area or for further processing by any known means, including by hand or by a belt conveyor or by gravity. In the preferred embodiment depicted in FIG. 1, the cut reconstituted sheet drops out of the cutter directly on to the second drying apparatus 100. The second drying apparatus can be any drying apparatus, including a storage area for passive drying, a belt conveyor dryer or the preferred vibrating conveyor dryer.

The top wall 110 of the vibrating conveyor dryer 100 preferably has an aperture 120 directly below the cutter 90 such that the cut reconstituted sheet drops down from the cutter on to the surface 130 of the vibrating conveyor dryer 100. The vibrating action of the vibrating conveyor causes the cut sheets to flatten out and move along the surface of the conveyor in the direction desired. Air is blown into the vibrating conveyor dryer 100 at a first position 140 and is exhausted out, for example by the action of a fan 150, at a second position 160. The temperature of the air blown into the dryer can be varied depending on the length of the dryer and the amount of drying desired.

The following example is illustrative:

EXAMPLE

A slurry containing 80% moisture and 20% tobacco solids was prepared. The slurry was metered on to a heated roll using two application rolls while the heated roll was rotated, coating the heated roll with a 0.040 inch thick layer of slurry. The heated roll was preheated to a temperature of 150° F. and was five and one-half feet wide and had a ten inch diameter. The heated roll was rotated 160° while the slurry was applied and then the flow of slurry on to the roll was stopped. The rotation of the roll was also stopped. The slurry was allowed to dry for 2 minutes. Then the slurry, which had dried into a coherent sheet, was scraped off of the heated roll with a sharp scraper. The moisture content of the sheet was 20%.

Thus, it is seen that an apparatus and method for manufacturing reconstituted tobacco sheet using a cylindrical dryer is provided. One skilled in the art will appreciate that the present invention can be practiced by other than the preferred embodiments which are presented for purposes of illustration and not of limitation, and the present invention is limited only by the claims which follow.

What is claimed is:

1. A method of making reconstituted tobacco sheet comprising the steps of:

metering a tobacco-containing slurry onto the outer surface of a cylindrical dryer;

drying the tobacco-containing slurry on the outer surface of the cylindrical dryer such that it forms a coherent reconstituted sheet; and removing the reconstituted sheet from the outer surface of the cylindrical dryer at a doctoring point.

2. The method of making reconstituted tobacco sheet set forth in claim 1 wherein the drying step comprises rotating and heating the cylindrical dryer at a temperature and rate of rotation such that the tobacco-containing slurry at the doctoring point forms a coherent reconstituted sheet in less than a full rotation of the cylindrical dryer.

3. The method of making reconstituted tobacco sheet as set forth in claim 1 further comprising:

transporting the reconstituted sheet produced from the removing step to a cutting apparatus;

cutting the reconstituted sheet with the cutting apparatus to form cut reconstituted sheet; and drying the cut reconstituted sheet.

4. The method of making reconstituted tobacco sheet as set forth in claim 3 wherein said transporting step comprises conveying the reconstituted sheet on a belt conveyor.

5. The method of making reconstituted tobacco sheet as set forth in claim 3 wherein said drying step comprises drying the cut reconstituted sheet on a vibrating conveyor dryer.

6. The method of making reconstituted tobacco sheet as set forth in claim 1 wherein said drying step comprises heating the cylindrical dryer with steam to a temperature not exceeding 200° F.

7. The method of making reconstituted tobacco sheet as set forth in claim 1 wherein said removing step comprises removing the coherent reconstituted sheet from the outer surface of the cylindrical dryer with a blade.

8. The method of making reconstituted tobacco sheet as set forth in claim 1 wherein said drying step comprises heating the cylindrical dryer to a temperature between 180° F. and 200° F.

9. The method of making reconstituted tobacco sheet as set forth in claim 1 wherein said drying step comprises drying the reconstituted sheet to a moisture level of between 10% and 20%.

10. The method of making reconstituted tobacco sheet as set forth n claim 1 wherein said drying step comprises the steps of heating the cylindrical dryer to a temperature of 200° and rotating the cylindrical dryer at a rate of one rotation per minute.

11. The method of making reconstituted tobacco sheet as set forth in claim 5 wherein said drying step further comprises flattening the cut reconstituted sheet on a vibrating conveyor dryer.

* * * * *